US008703678B2

(12) United States Patent
Fujinami et al.

(10) Patent No.: US 8,703,678 B2
(45) Date of Patent: Apr. 22, 2014

(54) GREASE

(75) Inventors: Yukitoshi Fujinami, Ichihara (JP); Tahei Okada, Ichihara (JP); Shinya Nakatani, Fujisawa (JP); Atsushi Yokouchi, Fujisawa (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 0 days.

(21) Appl. No.: 12/444,472

(22) PCT Filed: Oct. 5, 2007

(86) PCT No.: PCT/JP2007/069601

§ 371 (c)(1),
(2), (4) Date: Apr. 6, 2009

(87) PCT Pub. No.: WO2008/044650

PCT Pub. Date: Apr. 17, 2008

(65) Prior Publication Data

US 2010/0035779 A1 Feb. 11, 2010

(30) Foreign Application Priority Data

Oct. 6, 2006 (JP) ..... 2006-275436

(51) Int. Cl.
*C10M 105/36* (2006.01)
*C10M 115/08* (2006.01)
*C07C 69/34* (2006.01)

(52) U.S. Cl.
USPC ..... 508/496; 508/552; 560/190

(58) Field of Classification Search
USPC ..... 508/433, 496, 552; 560/190
See application file for complete search history.

(56) References Cited

U.S. PATENT DOCUMENTS

| | | | | |
|---|---|---|---|---|
| 2,436,347 | A | 2/1948 | Zimmer et al. | |
| 2,889,281 | A | 6/1959 | Matuszak et al. | |
| 3,502,580 | A | 3/1970 | Coupland | |
| 3,869,394 | A * | 3/1975 | Daniels et al. | 508/252 |
| 5,580,482 | A * | 12/1996 | Chasan et al. | 508/243 |
| 2002/0082175 | A1* | 6/2002 | Iso et al. | 508/287 |
| 2003/0040442 | A1* | 2/2003 | Yokouchi et al. | 508/155 |
| 2005/0065254 | A1 | 3/2005 | Lappe et al. | |
| 2005/0261141 | A1 | 11/2005 | Iso et al. | |
| 2006/0073989 | A1 | 4/2006 | Fujita et al. | |
| 2008/0166080 | A1 | 7/2008 | Kawamura | |

FOREIGN PATENT DOCUMENTS

| | | | |
|---|---|---|---|
| EP | 1 516 865 | A1 | 3/2005 |
| GB | 786767 | | 11/1957 |
| JP | 26 4027 | | 7/1951 |
| JP | 46 41227 | | 12/1971 |
| JP | 55-11156 | A | 1/1980 |
| JP | 10-88158 | A | 4/1998 |
| JP | 10 088159 | | 4/1998 |
| JP | 11 82688 | | 3/1999 |
| JP | 2000 234638 | | 8/2000 |
| JP | 2004 197802 | | 7/2004 |
| JP | 2005 89465 | | 4/2005 |
| JP | 2005-105238 | A | 4/2005 |
| JP | 2005-298629 | A | 10/2005 |
| JP | 2006-77967 | A | 3/2006 |
| JP | 2006 132619 | | 5/2006 |
| JP | 2006 153182 | | 6/2006 |
| JP | 2006 161827 | | 6/2006 |
| JP | 2006 162032 | | 6/2006 |
| JP | 2006-225519 | A | 8/2006 |

OTHER PUBLICATIONS

U.S. Appl. No. 12/447,146, filed Apr. 24, 2009, Fujinami, et al.
Extended European Search Report issued May 2, 2012, in Patent Application No. 07829339.6.

* cited by examiner

*Primary Examiner* — Prem Singh
*Assistant Examiner* — Vishal Vasisth
(74) *Attorney, Agent, or Firm* — Oblon, Spivak, McClelland, Maier & Neustadt, L.L.P.

(57) ABSTRACT

A grease which comprises a base oil containing at least 50% by mass of a diester compound having a total carbon number of 28 to 40 and represented by the general formula (I):

$$R^1OOC—(R^2)_n—COOR^3 \quad (I)$$

wherein $R^1$ and $R^3$ each independently represent a $C_4$ to $C_{20}$ monovalent aliphatic hydrocarbon group, $R^2$ represents a $C_1$ to $C_{20}$ divalent hydrocarbon group and n is 0 or 1. The grease is excellent in both low-temperature performance and high-temperature performance and has low oil separation tendency even under high centrifugal force (acceleration). In particular, when the grease is used in a rotational transmission device having a built-in one-way clutch, the grease can provide satisfactory clutch engagement property (intermeshing ability) at low temperatures and a prolonged bearing life at high temperatures and is less apt to cause oil separation under high centrifugal force.

13 Claims, No Drawings

GREASE

This application is a 371 of PCT/JP07/69601 filed Oct. 5, 2007.

TECHNICAL FIELD

The present invention relates to a grease and, more specifically, to a grease which excels in both low-temperature performance and high-temperature performance, which has low oil separation tendency even under high centrifugal force and which is particularly suited for use in a rotational transmission device having a built-in one-way clutch.

BACKGROUND ART

Greases which permit easier handling as compared with lubricating oils are widely used for lubricating various lubrication sites of automobiles and various industrial machines.

There are a number of kinds of greases. For example, JIS (Table 1 of JIS K2220) refers to greases for use in various applications and specifies properties and performance required in respective applications. For example, "grease class 3 for ball or roller bearing" is defined as being applicable over a wide-temperature range, excellent in low-temperature performance and in heat resistance and usable for ball or roller bearings in a temperature range of −30 to 130° C.

In recent years, mechanical parts of automobiles and various other industrial machines have been designed to be operable in a wider temperature range and under more severe lubrication conditions than before. Additionally, as a result of development of new types of machines and mechanical parts, not only operability in a wider temperature range and under more severe lubrication conditions but also performance specific to such machines is now often required.

For example, in recent years, for the transmission of a driving force in a specific direction only, a rotational transmission device with a built-in one-way clutch has been used in automobile auxiliaries such as an alternator, auxiliary driving device and engine crankshaft, for example. The rotational transmission device with a built-in one-way clutch is a device which includes an inner-diameter-side member; a cylindrical, outer-diameter-side member concentrically located around the inner-diameter-side member; ball or roller bearings located between the outer surface of the inner-diameter-side member and the inner surface of the outer-diameter-side member for supporting the inner-diameter-side member and the outer-diameter-side member while permitting relative rotation therebetween; and a one-way clutch adapted for transmitting only such a rotational force that rotates one of the outer-diameter-side member and the inner-diameter-side member relative to the other in a specified direction.

Such an alternator and the like now progress in performance and output and are also used in a wide area including cold climate areas. As a consequence, the conditions under which the rotational transmission device with a built-in one-way clutch is used become severe. Namely, the rotational transmission device is required to operate at a higher revolution speed and a higher load and to achieve a desired performance under an extremely low temperature so as to withstand use in cold climate areas. In this circumstance, a grease used in such a rotational transmission device with a built-in one-way clutch operated under severe conditions is desired to produce a high performance and to satisfy the following characteristics:

(i) The grease must provide satisfactory clutch engagement property (intermeshing ability) at low temperatures. When an engine is started in an extremely cold area in winter, satisfactory clutch engagement property (intermeshing ability) is demanded in order to achieve smooth operation.

(ii) The grease must have excellent performance at high temperatures and provide a prolonged bearing life at high temperatures. As a consequence of severe engine operation conditions, the temperature of location near the engine becomes high. Additionally, automobile auxiliaries are operated at high temperatures for a long period of time. Therefore, the grease must provide a prolonged bearing life at high temperatures.

(iii) The grease must be less apt to cause oil separation under high centrifugal force (acceleration). Since automobile auxiliaries such as alternator, are operated at high revolution speed and used under high centrifugal force, the grease must be less apt to cause oil separation.

It is known that the grease performance at low temperatures may be improved by using a low viscosity base oil. A grease using a low viscosity base oil, however, cannot achieve a good performance at high temperatures, because the base oil is apt to vaporize and to cause oil separation. When, on the other hand, a high viscosity base oil is used, the grease performance at low temperatures is deteriorated though the grease performance at high temperatures is improved.

Namely, the good clutch engagement property as described in (i) above and the long life of bearings in a test at high temperatures as described in (ii) above are generally opposing properties. Thus, when one of the two properties is improved, the other property is deteriorated. It is, therefore, difficult to improve both properties at the same time. Also, to reduce oil separation under a high centrifugal force as described in (iii) above and to improve performance at low temperatures as described in (i) above are also opposing properties.

As conventional greases for use in such a rotational transmission device with a built-in one-way clutch, there are disclosed a grease in which an ether-based base oil such as an alkyl diphenyl ether is used (see, for example, Patent Documents 1 and 2), a grease in which a polyol ester having a kinematic viscosity at 40° C. of 20 $mm^2/s$ or less is used (see, for example, Patent Document 3), a grease in which a thickener composed of a diurea compound and a mineral oil, a poly-α-olefin oil or a polyol ester oil is used (see, for example, Patent Document 4), and a grease in which a urea thickener is compounded into an ester-based or synthetic oil-based base oil having a pressure viscosity coefficient of 12 $Pa^{-1}$ or more (see, for example, Patent Document 5).

The grease using an alkyl diphenyl ether is not satisfactory with respect to low temperature properties, i.e. clutch engagement property at low temperatures. The grease using a base oil containing a polyol ester is unsatisfactory with respect to high temperature property, i.e. the results of a bearing life test at high temperatures are unsatisfactory. Thus, the above two greases cannot satisfy the low temperature performance and high temperature performance at the same time. The other greases using a mineral oil or a poly-α-olefin oil have similar problems. Accordingly, there is a room for further improving the grease.

[Patent Document 1] Japanese Unexamined Patent Application Publication No. 2006-162032

[Patent Document 2] Japanese Unexamined Patent Application Publication No. H11-82688

[Patent Document 3] Japanese Unexamined Patent Application Publication No. 2006-161827

[Patent Document 4] Japanese Unexamined Patent Application Publication No. 2006-132619

[Patent Document 5] Japanese Unexamined Patent Application Publication No. 2000-234638

DISCLOSURE OF THE INVENTION

Problem to be Solved by the Invention

Under the above-mentioned circumstance, the present invention has as its object the provision of a grease which excels in both low-temperature performance and high-temperature performance, which has reduced oil separation even under high centrifugal force (acceleration) and which, when used in a rotational transmission device having a built-in one-way clutch, can provide satisfactory clutch engagement property (intermeshing ability) at low temperatures and a prolonged bearing life at high temperatures and is less apt to cause oil separation under high centrifugal force.

Means for Solving the Problem

The present inventors have made an earnest study with a view toward developing a grease having the above desirable properties and, as a result, have found that the above problems can be solved by using a grease containing as a base oil a diester of a dicarboxylic acid having a total carbon number in a specific range. The present invention has been completed based on the above finding.

That is, the present invention provides the following greases:

(1) A grease comprising a base oil containing at least 50% by mass of a diester compound having a total carbon number of 28 to 40, the diester compound being represented by the general formula (I)

$$R^1OOC—(R^2)_n—COOR^3 \quad (I)$$

wherein $R^1$ and $R^3$ each independently represent a $C_4$ to $C_{20}$ monovalent aliphatic hydrocarbon group, $R^2$ represents a $C_1$ to $C_{20}$ divalent hydrocarbon group and n is 0 or 1.

(2) The grease as defined in above (1), wherein $R^1$ and $R^3$ in the general formula (I) each represent a branched, monovalent aliphatic hydrocarbon group.

(3) The grease as defined in above (1) or (2), wherein, in the general formula (I), n is 1, $R^2$ represents a $C_3$ to $C_{15}$ divalent hydrocarbon group, and $R^1$ and $R^3$ are the same and each represent a $C_6$ to $C_{17}$ monovalent aliphatic hydrocarbon group.

(4) The grease as defined in any one of above (1) to (3), wherein the diester compound represented by the general formula (I) has a total carbon number of 30.

(5) The grease as defined in any one of above (1) to (4), further comprising a viscosity increasing agent.

(6) The grease as defined in any one of above (1) to (5), further comprising at least one additive selected from the group consisting of a lubricity improver, an antioxidant and a rust preventing agent.

(7) The grease as defined in any one of above (1) to (6), wherein an oil component of the grease has a kinematic viscosity at 40° C. of 15 to 150 $mm^2/s$, the oil component is a component remaining after removing a thickener from the grease.

(8) The grease as defined in any one of above (5) to (7), wherein a urea thickener is used.

(9) The grease as defined in above (8), wherein the urea thickener is a diurea compound represented by the following general formula (V):

$$R^4—NHCONH—R^5—NHCONH—R^6 \quad (V)$$

wherein $R^4$ and $R^6$ each independently represent a $C_6$ to $C_{14}$ monovalent chain hydrocarbon group, a $C_6$ to $C_{12}$ monovalent alicyclic hydrocarbon group or a $C_6$ to $C_{12}$ monovalent aromatic hydrocarbon group, and $R^5$ represents a $C_6$ to $C_{15}$ divalent aromatic hydrocarbon group.

(10) The grease as defined in above (9), wherein the chain hydrocarbon group represented by $R^4$ and $R^6$ in the general formula (V) has a carbon number of 13 to 20.

(11) The grease as defined in above (9) or (10), wherein the groups $R^4$ and $R^6$ in the general formula (V) satisfy the following formulas (a) and (b):

$$[(X+Y)/(X+Y+Z)]\times 100 \geq 90 \quad (a)$$

$$X/Y=50/50 \text{ to } 0/100 \quad (b)$$

wherein X is a content (mole %) of the chain hydrocarbon groups, Y is a content (mole %) of the alicyclic hydrocarbon groups and Z is a content (mole %) of the aromatic hydrocarbon groups in the groups $R^4$ and $R^6$.

(12) The grease as defined in any one of above (1) to (11), wherein the grease is used in a rotational transmission device.

(13) The grease as defined in any one of above (1) to (11), wherein the grease is used in a rotational transmission device having a built-in one-way clutch.

Effect of the Invention

According to the present invention, there can be provided a grease which excels in both low-temperature performance and high-temperature performance, which has low oil separation tendency even under high centrifugal force (acceleration) and which, when used in a rotational transmission device having a built-in one-way clutch, can provide satisfactory clutch engagement property (intermeshing ability) at low temperatures and a prolonged bearing life at high temperatures and is less apt to cause oil separation under high centrifugal force.

BEST MODE FOR CARRYING OUT THE INVENTION

A grease of the present invention is characterized by using a base oil containing at least 50% by mass of a diester compound which has a total carbon number of 28 to 40 and which is represented by the general formula (I):

$$R^1OOC—(R^2)_n—COOR^3 \quad (I)$$

wherein $R^1$ and $R^3$ each independently represent a $C_4$ to $C_{20}$ monovalent aliphatic hydrocarbon group, $R^2$ represents a $C_1$ to $C_{20}$ divalent hydrocarbon group and n is 0 or 1.

As the $C_1$ to $C_{20}$ divalent hydrocarbon group represented by $R^2$ in the above general formula (I), there may be mentioned a straight chained or branched $C_1$ to $C_{20}$ alkylene group, a straight chained or branched $C_2$ to $C_{20}$ alkenylene group, a divalent $C_5$ to $C_{20}$ alicyclic structure-containing group, and a divalent $C_6$ to $C_{20}$ aromatic ring structure-containing group.

A dicarboxylic acid from which the above diester compound is derived may be represented by the following general formula (II):

$$HOOC—(R^2)_n—COOH \quad (II)$$

wherein $R^2$ and n are as defined above. When n is 0, the dicarboxylic acid is oxalic acid. As the dicarboxylic acid in which n is 1, there may be mentioned the following compounds.

Examples of the dicarboxylic acid of the above formula in which $R^2$ represents a straight chained or branched $C_1$ to $C_{20}$ alkylene group include malonic acid, succinic acid, 2-methylsuccinic acid, glutaric acid, adipic acid, various heptanedioic acids such as pimelic acid, various octanedioic acids such as suberic acid, various nonanedioic acids such as azelaic acid, various decanedioic acids such as sebacic acid, various undecanedioic acids, various dodecanedioic acids, various tridecanedioic acid, various tetradecanedioic acids, various pentadecanedioic acids, various hexadecanedioic acids, various heptadecanedioic acids, various octadecanedioic acids, various eicosanedioic acids and various docosanedioic acids.

Examples of the dicarboxylic acid of the above formula in which $R^2$ represents a straight chained or branched $C_2$ to $C_{20}$ alkenylene group include maleic acid, fumaric acid, itaconic acid, citraconic acid (cis-methylbutenedioic acid), mesaconic acid (trans-methylbutenedioic acid), various hexenedioic acid, various octenedioic acid, various decenedioic acid, various dodecenedioic acid, various tetradecenedioic acids, various hexadecenedioic acids, various octadecenedioic acid, various eicosenedioic acids and various docosenedioic acids.

Examples of the dicarboxylic acid of the above formula in which $R^2$ represents a divalent $C_5$ to $C_{20}$ alicyclic structure-containing group include various cyclopentane dicarboxylic acids, various cyclopentene dicarboxylic acids, various cyclohexane dicarboxylic acids, various cyclohexene dicarboxylic acids, various tetralin dicarboxylic acids and various decalin dicarboxylic acids. These alicyclic structure-containing dicarboxylic acids may contain a suitable substituent or substituents such as alkyl groups on their rings.

Examples of the dicarboxylic acid of the above formula in which $R^2$ represents a divalent $C_6$ to $C_{20}$ aromatic structure-containing group include phthalic acid, isophthalic acid, terephthalic acid, naphthalene-2,3-dicarboxylic acid, naphthalene-1,4-dicarboxylic acid and naphthalene-2,6-dicarboxylic acid. These aromatic ring structure-containing dicarboxylic acids may contain a suitable substituent or substituents such as alkyl groups on their rings.

In the present invention, it is preferred that n be 1 and $R^2$ be a divalent $C_3$ to $C_{15}$ hydrocarbon group in the above general formulas (I) and (II).

As the monovalent $C_4$ to $C_{20}$ aliphatic hydrocarbon group represented by $R^1$ and $R^3$ in the above general formula (I), there may be mentioned a straight chained or branched alkyl group, a straight chained or branched alkenyl group or an alicyclic structure-containing group. The carbon number of the monovalent aliphatic hydrocarbon group is determined in view of the carbon number of the group $R^2$ so that a total carbon number of the diester compound falls within a range of 28 to 40.

When n is 1 and $R^2$ is a divalent $C_3$ to $C_{15}$ hydrocarbon group as described above, it is preferred, for reasons of easiness of production, that $R^1$ and $R^3$ be the same with each other and each represent a monovalent $C_6$ to $C_{17}$ aliphatic hydrocarbon group and that a total carbon number of the diester compound be within a range of 28 to 40. It is more preferred that $R^1$ and $R^3$ be the same with each other and each represent a monovalent $C_6$ to $C_{14}$ aliphatic hydrocarbon group and that a total carbon number of the diester compound be within a range of 28 to 34. It is still more preferred that $R^1$ and $R^3$ be the same with each other and each represent a monovalent $C_7$ to $C_{14}$ aliphatic hydrocarbon group and that a total carbon number of the diester compound be within a range of 30 to 34. In this case it is particularly preferred that a total carbon number of the diester compound be 30.

Alcohols from which the above diester compound is derived are represented by the following general formulas (III) and (IV):

$$R^1\text{—OH} \quad \text{(III)}$$

$$R^3\text{—OH} \quad \text{(IV)}$$

wherein $R^1$ and $R^3$ are as defined above. As the alcohols of the above formulas in which $R^1$ and $R^3$ are each a straight chained or branched alkyl group, there may be mentioned various butyl alcohols, various pentyl alcohols, various hexyl alcohols, various octyl alcohols, various nonyl alcohols, various decyl alcohols, various dodecyl alcohols, various tetradecyl alcohols and various hexadecyl alcohols.

As the alcohols of the above formulas in which $R^1$ and $R^3$ are each a straight chained or branched alkenyl group, there may be mentioned various butenyl alcohols, various hexenyl alcohols, various octenyl alcohols, various decenyl alcohols, various dodecenyl alcohols, various tetradecenyl alcohols and various hexadecenyl alcohols.

As the alcohols of the above formulas in which $R^1$ and $R^3$ are each an alicyclic structure-containing group, there may be mentioned cyclopentyl alcohol, cyclopentanemethanol, cyclopentenyl alcohol, cyclopentenemethanol, cyclohexyl alcohol, cyclohexanemethanol, cyclohexenyl alcohol and cyclohexenemethanol. These alicyclic structure-containing alcohols may contain a suitable substituent or substituents such as alkyl groups on their rings.

In the present invention, it is preferred that $R^1$ and $R^3$ be a branched, monovalent aliphatic hydrocarbon group. In this case, alicyclic structure-containing groups are intended to be comprised by the branched groups.

As the branched, monovalent aliphatic hydrocarbon group, a branched alkyl group is preferred. Specific examples of the branched alkyl group include an isopentyl group, a tert-pentyl group, an isohexyl group, an isooctyl group, a 2-ethylhexyl group, a 2-propylheptyl group, a 2-butyloctyl group, a 3,5,5-trimethylhexyl group, an isononyl group, a 3,7-dimethyloctyl group, a 2-pentylnonyl group and a 2-hexyldecyl group.

Among alcohols represented by the above general formulas (III) and (IV), a branched alcohol may be produced, for example, by Guerbet reaction in which a primary alcohol is subjected to bimolecular condensation at a high temperature and a high pressure, by an oxo synthesis method or by dimerization or oligomerization of an α-olefin.

Specific examples of the diester compound represented by the above general formula (I) include di-2-butyloctyl adipate, diisotridecyl adipate, di-2-pentylnonyl adipate; diisodecyl pimelate, di-2-butyloctyl pimelate; diisodecyl suberate, di-2-propylheptyl suberate, di-3,7-dimethyloctyl suberate, di-2-butyloctyl suberate; diisodecyl azelate, di-2-propylheptyl azelate, di-3,7-dimethyloctyl azelate, di-2-butyloctyl azelate; diisononyl sebacate, di-3,5,5-trimethylhexyl sebacate, diisodecyl sebacate, di-2-propylheptyl sebacate, di-3,7-dimethyloctyl sebacate, di-2-butyloctyl sebacate; di-2-ethylhexyl dodecanedioate, diisooctyl dodecanedioate, diisononyl dodecanedioate, di-3,5,5-trimethylhexyl dodecanedioate, diisodecyl dodecanedioate, di-3,7-dimethyloctyl dodecanedioate; diisooctyl tetradecanedioate, di-2-ethylhexyl tetradecanedioate, diisononyl tetradecanedioate, di-3,5,5-trimethylhexyl tetradecanedioate, diisodecyl tetradecanedioate, di-3,7-dimethyloctyl tetradecanedioate; diisodecyl cyclohexane-1,2-dicarboxylate, di-2-propylheptyl cyclohexane-1,2-dicarboxylate, di-3,7-dimethyloctyl cyclohexane-1,2-dicarboxylate, di-2-butyloctyl cyclohexane-1,2-dicarboxylate; various dialkyl esters obtainable by replacing the cyclohexane-1,2-dicarboxylic acid moiety of the above-described dialkyl cyclohexane-1,2-dicarboxylates by a cyclohexane-1,3-dicarboxylic acid moiety or a cyclohexane-1,4-dicarboxylic acid moiety; diisodecyl phthalate, di-2-propylheptyl phthalate, di-3,7-dimethyloctyl phthalate, di-2-butyloctyl phthalate; and various dialkyl esters obtainable by replacing the phthalic acid moiety of the above-described dialkyl phthalates by an isophthalic acid moiety or a terephthalic acid moiety.

There is no specific restriction on a method for preparing the diester compounds represented by the above general formula (I). The desired diester compound may be obtained by subjecting the above-described dicarboxylic acids and alcohols to esterification by any conventionally known method.

The above-described diester compounds may be used singly or in combination of two or more thereof. It is essential that the diester compound should be contained in the base oil in an amount of 50% by mass or more. When the content of the diester compound in the base oil is 50% by mass or more, it is possible to obtain a grease which satisfies properties required for use in various applications, especially a grease for use in a rotational transmission device having a built-in one-way clutch. The content is preferably 70% by mass or more, more preferably 80% by mass or more, still more preferably 90% by mass or more.

The grease of the present invention may contain other base oil, if desired, in an amount of 50% by mass or less, preferably 30% by mass or less, more preferably 20% by mass or less, still more preferably 10% by mass or less, as long as the effect of the present invention is not adversely affected.

As the "other base oil," there may be mentioned, for example, alicyclic hydrocarbon compounds, mineral oils and various synthetic oils.

Examples of the alicyclic hydrocarbon compounds include alkane derivatives having two or more cyclohexane rings, such as 2,4-dicylohexyl-2-methylpentane and 2,4-dicyclohexylpentane; alkane derivatives having one or more decalin rings and one or more cyclohexyl rings, such as 1-cyclohexyl-1-decalylethane; and alicyclic compounds having two or more bicyclo[2.2.1]heptane rings, bicyclo[3.2.1]octane rings, bicyclo[2.2.2]octane rings and/or bicyclo[3.2.0]octane rings, such as endo-2-methyl-exo-3-methyl-exo-2-[(exo-3-methylbicyclo[2.2.1]hepto-exo-2-yl)methyl]-bicyclo[2.2.1]heptane.

Examples of the mineral oil include paraffinic mineral oils and naphthenic mineral oil. Examples of the synthetic oils include poly-α-olefins such as 1-decene oligomers, polybutenes, alkyl benzenes, alkyl naphthalenes and polyalkylene glycols.

In the present invention, the base oil may contain a viscosity increasing agent. The viscosity increasing agent is used, if necessary, to increase the viscosity of the base oil and to adjust the kinematic viscosity thereof to a proper value.

Specific examples of the viscosity increasing agent include polybutene, polyisoprene, polymethacrylate (PMA), an olefin copolymer (OCP), polyalkylstyrene (PAS) and a styrene-diene copolymer (SCP). It is particularly preferable to use at least one selected from polybutene, polyisobutyrene, a styrene-isoprene copolymer, an ethylene-α-olefin copolymer (all of which have a number average molecular weight of 800 to 10,000, more preferably 1,000 to 5,000) and polymethacrylate which has a weight average molecular weight of 10,000 to 1,000,000, preferably 100,000 to 800,000. The compounding amount of the viscosity increasing agent is generally about 0.01 to 20% by mass, in terms of the amount of resin, based on the weight of the composition. The compounding amount is suitably selected so that the viscosity of an oil component of the grease (which will be described hereinbelow) has a desired viscosity value.

It is preferred that a kinematic viscosity at 40° C. of an oil component of the grease be adjusted. The term "oil component" as used herein is intended to refer to a component remaining after removing a thickener from the grease. More specifically, the oil component is a mixture of the above-described base oil, the above-described viscosity increasing agent and various additives which will be described hereinafter. Namely, when neither the viscosity increasing agent nor additives are compounded, the oil component is the base oil only. When the base oil and viscosity increasing agent are used without compounding additives, then a mixture of the base oil and viscosity increasing agent is the oil component. When the base oil is used together with the viscosity increasing agent and additives, a mixture of them is the oil component.

The oil component may be obtained as a separated matter by centrifuging the grease.

It is preferred that the oil component of the grease of the present invention have a kinematic viscosity at 40° C. of 15 to 150 $mm^2/s$, more preferably 20 to 90 $mm^2/s$, still more preferably 30 to 60 $mm^2/s$. When the kinematic viscosity at 40° C. of the oil component is 15 $mm^2/s$ or more, oil separation of the grease may be suppressed. When the kinematic viscosity at 40° C. of the oil component is 150 $mm^2/s$ or less, the properties of the grease at low temperatures may be maintained in good conditions.

The grease of the present invention may be obtained by compounding a thickener into a base oil containing at least 50% by mass of a diester compound having a total carbon number of 28 to 40 and represented by the above general formula (I).

The thickener used in the present invention is not specifically restricted. Either a soap thickener or a non-soap thickener may be used. Preferably used is a thickener which can provide a grease having a dropping point of 230° C. or higher. When the grease has a dropping point of 230° C. or higher, a possibility of causing problems in relation to lubrication such as softening at high temperatures and resulting leakage or seizing may be suppressed.

As the soap thickener, there may be mentioned a metal soap obtained by saponifying a carboxylic acid or its ester with a metal hydroxide such as an alkali metal hydroxide or an alkaline earth metal hydroxide.

Examples of the metal include sodium, calcium, lithium and aluminum. Examples of the carboxylic acid include crude fatty acids obtained by hydrolyzing fats and oils, followed by removal of glycerin, monocarboxylic acids such as stearic acid, monohydroxycarboxylic acids such as 12-hydroxystearic acid, dibasic carboxylic acids such as azelaic acid, and aromatic carboxylic acids such as terephthalic acid, salicylic acid and benzoic acid. These soap thickeners may be used singly or in combination of two or more thereof.

Preferred example of the soap thickener is a lithium 12-hydroxystearate. When compounding a soap thickener into a base oil, it is possible to add a carboxylic acid and the above-mentioned metal hydroxide into the base oil to perform saponification thereof in the base oil.

As another type of the soap thickener, there may be mentioned various complex soaps. Examples of the complex soap include a lithium complex soap, an aluminum complex soap and a calcium complex soap.

The lithium complex soap, which is a lithium-based complex soap, may be obtained by reacting a fatty acid, such as stearic acid, oleic acid or palmitic acid, and/or a $C_{12}$ to $C_{24}$ hydroxy fatty acid having at least one hydroxyl group with a lithium compound, such as lithium hydroxide, together with an aromatic carboxylic acid and/or $C_2$ to $C_{12}$ (more preferably $C_4$ to $C_9$) aliphatic dicarboxylic acid. Such a lithium complex soap is a more preferable thickener because of its superior heat resistance as compared with a lithium soap.

The $C_{12}$ to $C_{24}$ hydroxy fatty acid is not specifically limited and may be, for example, 12-hydroxystearic acid, 12-hydroxylauric acid or 16-hydroxypalmitic acid. Among these, 12-hydroxystearic acid is particularly preferred.

As the aromatic carboxylic acid, there may be, for example, benzoic acid, phthalic acid, isophthalic acid, terephthalic acid, trimelitic acid, pyromelitic acid, salicylic acid and p-hydroxybenzoic acid.

The $C_2$ to $C_{12}$ aliphatic dicarboxylic acid is not specifically limited and may be, for example, azelaic acid, sebacic acid, oxalic acid, malonic acid, succinic acid, adipic acid, pimelic acid, suberic acid, undecanedioic acid and dodecanedioic acid. Above all, azelaic acid is preferred.

It is preferred that the aromatic carboxylic acid and/or $C_2$ to $C_{12}$ aliphatic dicarboxylic acid be present in an amount of 20 to 90% by mass based on a total mass of the fatty acid and/or $C_{12}$ to $C_{24}$ hydroxy fatty acid having at least one hydroxyl group and the aromatic carboxylic acid and/or $C_2$ to $C_{12}$ aliphatic dicarboxylic acid. When the amount is within the range of 20 to 90% by mass, a thickener having good thermal stability may be obtained and a grease having a long service life at high temperatures may be advantageously obtained.

As a non-soap thickener, a urea compound or bentonite treated with an organic compound may be used.

As the urea compound used as the thickener, there may be used any urea compound which has been hitherto utilized as a urea thickener. Examples of the urea compound include a diurea compound, a triurea compound, a tetraurea compound and a urea-urethane compound.

Because the urea compound has excellent heat resistance and water resistance and is particularly excellent in stability at high temperatures, it is suitably used in a high temperature environment.

Of the above-described various thickeners, lithium soap thickeners, preferably lithium complex soaps, and urea thickeners are suitably used in the present invention. Because of excellent performance, the urea thickeners are particularly preferred. Of the urea thickeners, diurea compounds are particularly preferred.

As the diurea compound, there may be mentioned, for example, a compound represented by the following general formula (V):

$$R^4NHCONHR^5NHCONHR^6 \quad (V)$$

wherein $R^4$ and $R^6$ each independently represent a monovalent $C_6$ to $C_{24}$ chained hydrocarbon group, a monovalent $C_6$ to $C_{12}$ alicyclic hydrocarbon group or a monovalent $C_6$ to $C_{12}$ aromatic hydrocarbon group and $R^5$ represents a divalent $C_6$ to $C_{15}$ aromatic hydrocarbon group.

As the divalent $C_6$ to $C_{15}$ aromatic hydrocarbon group represented by $R^5$ of the above general formula (V), there may be mentioned a phenylene group, a diphenylmethane group and a tolylene group.

The monovalent $C_6$ to $C_{24}$ chain hydrocarbon group represented by $R^4$ and $R^6$ of the above general formula (V) may be a straight chained or branched, saturated or unsaturated hydrocarbon group. Thus, as the monovalent $C_6$ to $C_{24}$ chain hydrocarbon group, there may be mentioned straight chained and branched chained hydrocarbon groups such as various hexyl groups, various heptyl groups, various octyl groups, various nonyl groups, various decyl groups, various undecyl groups, various dodecyl groups, various tridecyl groups, various tetradecyl groups, various pentadecyl groups, various hexadecyl groups, various heptadecyl groups, various octadecyl groups, various octadecenyl groups, various nonadecyl groups, various eicodecyl groups. Of these hydrocarbons, $C_{13}$ to $C_{20}$ straight chained or branched, saturated or unsaturated hydrocarbon groups are preferred. Particularly preferred are $C_{16}$ to $C_{18}$ chain hydrocarbon groups such as various hexadecyl groups, various heptadecyl groups, various octadecyl groups and various octadecenyl groups.

The monovalent $C_6$ to $C_{12}$ alicyclic hydrocarbon group represented by $R^4$ and $R^6$ of the above general formula (V) may be a cyclohexyl group or a $C_7$ to $C_{12}$ alkyl-substituted cyclohexyl group. Thus, the monovalent $C_6$ to $C_{12}$ alicyclic hydrocarbon group may be, for example, a cyclohexyl group, a methylcyclohexyl group, a dimethylcyclohexyl group, an ethylcyclohexyl group, a diethylcyclohexyl group, a propylcyclohexyl group, an isopropylcyclohexyl group, a 1-methylpropylcyclohexyl group, a butylcyclohexyl group, an amylcyclohexyl group, an amylmethylcylohexyl group or a hexylcyclohexyl group. Above all, a cyclohexyl group, a methylcyclohexyl group and an ethylcyclohexyl group are preferred for reasons of easiness of production.

The monovalent $C_6$ to $C_{12}$ aromatic hydrocarbon group represented by $R^4$ and $R^6$ of the above general formula (V) may be, for example, a phenyl group, a toluyl group, a benzyl group, an ethylphenyl group, a methylbenzyl group, a xylyl group, a propylphenyl group, a cumenyl group, an ethylbenzyl group, a methylphenethyl group, a butylphenyl group, a propylbenzyl group, an ethylphenethyl group, a pentylphenyl group, a butylbenzyl group, a propylphenethyl group, a hexylphenyl group, a pentylbenzyl group, a butylphenethyl group, or a heptylphenyl group.

In the present invention, the proportion of the hydrocarbon groups of $R^4$ and $R^6$ that constitute the terminal groups of the diurea compound, namely the composition of the raw material amines (or mixed amines) from which the $R^4$ and $R^6$ are derived, is not specifically limited. However, it is preferred that chain hydrocarbon groups or alicyclic hydrocarbon groups be the main components of the whole hydrocarbon groups. For example, it is preferred that the groups $R^4$ and $R^6$ satisfy the following formulas (a) and (b):

$$[(X+Y)/(X+Y+Z)]\times 100 \geq 90 \quad (a)$$

$$X/Y=50/50 \text{ to } 0/100 \quad (b)$$

wherein X is a content (mole %) of the chain hydrocarbon groups, Y is a content (mole %) of the alicyclic hydrocarbon groups and Z is a content (mole %) of the aromatic hydrocarbon groups in the groups $R^4$ and $R^6$.

When the above conditions (a) and (b) are met, tendency of oil separation, particularly oil separation under high centrifugal (acceleration) conditions may be suppressed.

The value of $[(X+Y)/(X+Y+Z)]\times 100$ in the formula (a) is more preferably 95 or more, particularly preferably 98 or more. The value of X/Y in the formula (b) is more preferably 30/70 to 5/95, particularly preferably 25/75 to 15/85.

The diurea compound may be generally obtained by reaction of a diisocyanate with a monoamine. The diisocyanate may be, for example, diphenylene diisocyanate, diphenylmethane diisocyanate, or tolylene diisocyanate. For reasons of harmlessness, diphenylmethane diisocyanate is preferred. The monoamine may be an amine corresponding to the chain hydrocarbon group, alicyclic hydrocarbon group or aromatic hydrocarbon group of $R^4$ and $R^6$ of the above general formula (V) and may be, for example, hexadecylamine, heptadecylamine, octadecylamine, octadecenylamine or the like chain hydrocarbon amine, cyclohexylamine or the like alicyclic hydrocarbon amine, octylphenylamine or the like aromatic hydrocarbon amine, or a mixture of these amines.

The compounding amount of the above-described thickener in the grease is not specifically restricted as long as the intended grease characteristics may be obtained but is preferably 10 to 30% by mass, more preferably 10 to 20% by mass, based on the grease.

The thickener used in the grease of the present invention serves to impart a desired penetration thereto. When the amount of the thickener is excessively small, a desired penetration is not obtainable. When the compounding amount is excessively large, the lubricity of the grease is reduced.

The grease according to the present invention may optionally contain a known additive or additives such as a lubricity improver, a detergent-dispersant, an antioxidant, an anti-corrosive agent, a rust preventing agent and an antifoaming agent as long as the object of the present invention is not adversely affected.

As the lubricity improver, there may be mentioned, for example, sulfur compounds (sulfurized fats and oils, sulfurized olefins, polysulfides, sulfurized mineral oils, thiophosphates such as triphenylphosphorothioate, thiocarbamic acids, thioterpenes, dialkylthiodipiropionates), phosphoric acid esters and phosphorous acid esters (tricresyl phosphate, triphenyl phosphite, etc.). As the detergent-dispersant, there may be mentioned, for example, succinimide and boron-containing succinimide.

As the antioxidant, there may be used an amine type antioxidant, a phenol type antioxidant or a sulfur type antioxidant. Among these, an amine type antioxidant is preferred. Examples of the amine type antioxidant include monoalkyldiphenylamine-based compounds such as monooctyldiphenylamine and monononyldiphenylamine; dialkyldiphenylamine-based compounds such as 4,4'-dibutyldiphenylamine, 4,4'-dipentyldiphenylamine, 4,4'-dihexyldiphenylamine, 4,4'-diheptyldiphenylamine, 4,4'-dioctyldiphenylamine and 4,4'-dinonyldiphenylamine; polyalkyldiphenylamine-based compounds such as tetradibutyldiphenylamine, tetrahexyldiphenylamine, tetraoctyldiphenylamine, tetranonyldiphenylamine; and naphthylamine-based compounds such as α-naphthylamine, phenyl-α-naphthylamine, butylphenyl-α-naphthylamine, pentylphenyl-α-naphthylamine, hexylphenyl-α-naphthylamine, heptylphenyl-α-naphthylamine, octylphenyl-α-naphthylamine and nonylphenyl-α-naphthylamine.

As the anti-corrosive agent, there may be mentioned, for example, benzotriazole type and thiazole type corrosion inhibitors. As the rust preventing agent, there may be mentioned, for example, metal sulfonate type and succinic ester type rust preventing agents. As the antifoaming agent, there may be mentioned, for example, silicone type and fluorinated silicone type antifoaming agents.

The compounding amount of the additives may be adequately determined according to the objects of their use. In general, a total amount of these additives is 30% by mass or less based on the grease.

A method for preparing the grease according to the present invention is not specifically limited. Generally, the following method may be used.

First, a base oil is added with a predetermined proportion of a thickener and, if desired, with a viscosity increasing agent. The mixture is heated to a predetermined temperature to obtain a homogeneous mixture.

This is then cooled. When a predetermined temperature is reached, various additives, if desired, are added in predetermined amounts, thereby obtaining a grease of the present invention.

The grease according to the present invention excels in both low-temperature performance and high-temperature performance, has reduced oil separation even under high centrifugal force (acceleration) and is suited for use in rotational transmission devices such as gears, belts, chains, traction drive transmissions, feed screws, clutches, telescopic shafts and bearings. In particular, the grease is useful for use in various bearings and pulleys for direct-acting devices and electrical accessories of automobiles. Especially, when the grease is used in a rotational transmission device having a built-in one-way clutch, the grease can provide satisfactory clutch engagement property (intermeshing ability) at low temperatures and a prolonged bearing life at high temperatures and is less apt to cause oil separation under high centrifugal force.

Examples

The present invention will be next described in more detail by way of examples. It should be noted that the present invention is not limited to these examples in any way.

The various properties were determined by the following methods.

(1) Kinematic Viscosity at 40° C. of Base Oil and Oil Component

The kinematic viscosity was measured in accordance with JIS K2283.

(2) Worked Penetration of Grease

The consistency was measured in accordance with JIS K2220.7.5.

(3) Property at Low Temperature: Engagement Property (Intermeshing Ability) Test A grease was charged in a clutch pulley unit (real unit) disclosed in FIG. 1 of Japanese Unexamined Patent Application Publication No. 2006-64136. An outer wheel was rotated in an interlocking state between the outer wheel and an inner wheel. The angular acceleration (limit angular speed: rad/$sec^2$) of the outer wheel beyond which the inner wheel failed to follow was measured. The higher the value, the better is the clutch engagement property (intermeshing ability).

(4) Property at High Temperatures: Bearing Life Test at High Temperatures

In 6305VV bearings (manufactured by NSK Ltd) were charged 3.4 g of a grease. The bearings were then continuously operated at 160° C., 10,000 rpm, a thrust load of 98 N and a radial load of 98 N to measure the time (bearing life time) at which the bearings are seized as a result of deterioration of the grease.

In the above experiment, a plurality (five) of bearings were tested. The measured values were Weibull-plotted, from which the life at accumulated probability of 50% (L50 life) was determined. The L50 life represents the bearing life.

(5) Oil Separation Under High Centrifugal Force

An ultracentrifuge "HIMAC CP70G" manufactured by Hitachi Koki Co., Ltd. was used. Grease was filled in a vessel and centrifuged at centrifugal acceleration of $1.8\times10^5$ $m^2/s$ (20,000 G) at 50° C. for 5 hours. A weight ratio of an oil component separated from the grease was determined as an amount of oil separation.

The base oils used were as follows:

Base Oil-1:

Diisodecyl sebacate obtained by esterification of sebacic acid with 3,7-dimethyloctyl alcohol (isodecyl alcohol) in the conventional manner was used. The diisodecyl sebacate has a total carbon number of 30, a kinematic viscosity of 20 $mm^2/s$ at 40° C., a flash point of 262° C. and a density of 0.913 $g/cm^3$.

Base Oil-2:

An alkylbenzene having a kinematic viscosity of 56 $mm^2/s$ at 40° C., a flash point of 192° C. and a density of 0.895 $g/cm^3$ was used.

Base Oil-3:

Diisononyl phthalate obtained by esterification of phthalic anhydride with 3,5,5-trimethylhexyl alcohol (isononyl alcohol) in the conventional manner was used. The diisononyl phthalate has a total carbon number of 26, a kinematic viscosity of 28 $mm^2/s$ at 40° C., a flash point of 236° C. and a density of 0.978 $g/cm^3$.

Base Oil-4:

Diester of neopentyl glycol with 3,5,5-trimethylhexyl alcohol having a kinematic viscosity of 13 $mm^2/s$ at 40° C., a flash point of 200° C. and a density of 0.913 $g/cm^3$ was used.

Example 1

A grease having the compounding composition shown in Table 1 was prepared using the base oil 1 and urea thickener 1 by the following method.

Diphenylmethane-4,4'-diisocyanate in the whole amount to be used was dissolved with heating in two thirds of the total amount to be used of the base oil 1 (including a viscosity increasing agent (polymethacrylate) having a weight average molecular weight of 450,000). In the remainder of the base oil-1, mixed amines (a mixture of n-octadecylamine and cyclohexylamine with 20:80 molar ratio) in an amount of two times the mole of the diphenylmethane-4,4'-diisocyanate were dissolved with heating.

The base oil 1 containing the diphenylmethane-4,4'-diisocyanate was charged in a grease production vessel and vigorously stirred at 50 to 60° C., to which the base oil 1 containing the mixed amines was gradually added with heating. After a temperature of 160° C. was reached, the grease was further maintained at that temperature for one hour. The compounding amount of the urea thickener was 17% by mass based on a total amount of the grease.

The resulting mixture was cooled to 80° C. at a rate of 50° C./h and blended with an antioxidant, a lubricity improver and a rust preventing agent. The resulting mixture was allowed to spontaneously cool to room temperature and then subjected to a finish treatment using a three-roll device to obtain a grease.

The thus obtained grease was measured for the worked penetration and subjected to the engagement property test (at −30° C., −20° C., 0° C. and 80° C.), the bearing life test at high temperatures and the oil separation test under high centrifugal force. The results are summarized in Table 1.

Examples 2 and 3

Greases were prepared in the same manner as that in Example 1 except that neither the viscosity increasing agent nor the lubricity improver was used and that the compounding amount of the urea thickener was changed as shown in Table 1. Each of the thus obtained greases was measured for the worked penetration and subjected to the engagement property test (at −30° C., −20° C., 0° C. and 80° C.), the bearing life test at high temperatures and the oil separation test under high centrifugal force. The results are summarized in Table 1.

Comparative Examples 1 to 3

Greases having the compositions shown in Table 1 were prepared in the manner described in Example 1 using the base oil or a combination of the base oil with the viscosity increasing agent, and the urea thickener as shown in Table 1. Each of the thus obtained greases was measured for the worked penetration and subjected to the engagement property test (at −30° C., −20° C., 0° C. and 80° C.), the bearing life test at high temperatures and the oil separation test under high centrifugal force. The results are summarized in Table 1.

Comparative Examples 4 to 6

Each of commercial products A, B and C was measured for the worked penetration and subjected to the engagement property test (at −30° C., −20° C., 0° C. and 80° C.), the bearing life test at high temperatures and the oil separation under high centrifugal force. The results are summarized in Table 1.

The commercial product A is a commercially available urea-based grease containing an alkyl-substituted diphenyl ether as a base oil, the commercial product B is a commercially available urea-based grease containing a pentaerythritol ester as a base oil, and the commercial product C is a commercially available urea-based grease containing a poly-α-olefin as a base oil.

TABLE 1

| | | | Example | | | Comparative Example |
|---|---|---|---|---|---|---|
| | | | 1 | 2 | 3 | 1 |
| Composition (% by mass) | Base oil | Base oil 1 | balance | balance | balance | — |
| | | Base oil 2 | — | — | — | balance |
| | | Base oil 3 | — | — | — | — |
| | | Base oil 4 | — | — | — | — |
| | Viscosity increasing agent [1)] | | 2 | — | — | — |
| | Urea thickener 1 [2)] | | 17 | 14 | 17.5 | 10.7 |
| | Antioxidant [3)] | | 5.0 | 5.0 | 5.0 | 5.0 |
| | Lubricity improver [4)] | | 2 | — | — | — |
| | Rust preventing agent [5)] | | 0.5 | 0.5 | 0.5 | 0.5 |
| Kinematic viscosity at 40° C. of oil component (component remaining after removing thickener from the grease)($mm^2/s$) | | | 41.2 | 23.2 | 23.2 | 56.7 |
| Evaluation results | Worked penetration | | 283 | 290 | 223 | 231 |
| | Engagement property test (limit angular speed $rad/sec^2$) | −30° C. | 60000< | 60000< | 60000< | 30000 |
| | | −20° C. | 60000< | 60000< | 60000< | 60000< |
| | | 0° C. | 60000< | 60000< | 60000< | 60000< |
| | | 80° C. | 60000< | 60000< | 60000< | 60000< |
| | Oil separation at high centrifugal force (% by mass) | | 5.3 | 9.1 | 3.6 | 2.3 |
| | Bearing life test at high temperature(160° C.) (h) | | 2942 | 1630 | 2793 | — |

TABLE 1-continued

| | | | Comparative Example | | | | |
|---|---|---|---|---|---|---|---|
| | | | 2 | 3 | 4 | 5 | 6 |
| Composition (% by mass) | Base oil | Base oil 1 | — | — | Commer-cial product A | Commer-cial product B | Commer-cial product C |
| | | Base oil 2 | — | — | | | |
| | | Base oil 3 | balance | — | | | |
| | | Base oil 4 | — | balance | | | |
| | Viscosity increasing agent [1] | | — | 2 | | | |
| | Urea thickener 1 [2] | | 17.9 | 10.1 | | | |
| | Antioxidant [3] | | 5.0 | 5.0 | | | |
| | Lubricity improver [4] | | — | — | | | |
| | Rust preventing agent [5] | | 0.5 | 0.5 | | | |
| Kinematic viscosity at 40° C. of oil component (component remaining after removing thickener from the grease)($mm^2/s$) | | | 28.6 | 27.7 | 103 | 33 | 96 |
| Evaluation results | Worked penetration | | 227 | 289 | 286 | 264 | 230 |
| | Engagement property test (limit angular speed rad/$sec^2$) | −30° C. | 47000 | 60000< | 34000 | 30000 | 19000 |
| | | −20° C. | 60000< | 60000< | — | — | 30000 |
| | | 0° C. | 60000< | 60000< | 50000 | 60000< | 60000< |
| | | 80° C. | 60000< | 60000< | 60000< | 60000< | 60000< |
| | Oil separation at high centrifugal force (% by mass) | | 2.5 | 8.8 | 7.1 | 7.2 | 5.6 |
| | Bearing life test at high temperature(160° C.) (h) | | — | 50 | 1930 | 1600 | 970 |

Remarks:

[1] Viscosity increasing agent: polymethacrylate having a weight average molecular weight of 450,000

[2] Urea thickener 1: product obtained by reacting diphenylmethane-4,4'-diisocyanate with a two-fold molar amount of mixed amines (a mixture of n-octadecylamine and cyclohexylamine), $[(X+Y)/(X+Y+Z)] \times 100 = 100$, X/Y = 20/80

[3] Antioxidant: a mixture of octylphenyl-1-naphthylamine (2 parts by weight), p,p'-dioctyldiphenylamine (2 parts by weight) and octadecyl-3-(3,5-di-tert-butyl-4-hydroxyphenyl)propionate (1 part by weight)

[4] Lubricity improver: triphenylphosphorothioate

[5] Rust preventing agent: zinc stearate

Examples 4 to 8

Greases having the compositions shown in Table 2 were prepared in the same manner as that in Example 1 using the base oil, the viscosity increasing agent and the urea thickener as shown in Table 2. The urea thickeners 2 used in these examples were prepared while changing mixing ratios of mixed amines (mixture of n-octadecylamine and cyclohexylamine) which were raw materials for preparing the urea thickener.

Each of the thus obtained greases was measured for the worked penetration and subjected to the oil separation test under high centrifugal force. The results are summarized in Table 2.

TABLE 2

| | | | Example | | |
|---|---|---|---|---|---|
| | | | 4 | 5 | 6 |
| Composition (% by mass) | Base oil 1 | | balance | balance | balance |
| | Urea thickener 2 [6] | Compounding amount | 18.5 | 17.5 | 14 |
| | | Mixing ratio of mixed amines X/Y(molar ratio) | 0/100 | 8/92 | 20/80 |
| | Antioxidant [3] | | 5.0 | 5.0 | 5.0 |
| | Lubricity improver [4] | | 2.0 | 2.0 | 2.0 |
| | Rust preventing agent [5] | | 0.5 | 0.5 | 0.5 |
| Kinematic viscosity at 40° C. of oil component (component remaining after removing thickener from the grease)($mm^2/s$) | | | 23.2 | 23.2 | 23.2 |
| Results | Worked penetration | | 281 | 269 | 284 |
| | Oil separation at high centrifugal force (% by mass) | | 14.0 | 10.1 | 9.1 |

| | | | Example | |
|---|---|---|---|---|
| | | | 7 | 8 |
| Composition (% by mass) | Base oil 1 | | balance | balance |
| | Urea thickener 2 [6] | Compounding amount | 15.7 | 13.4 |
| | | Mixing ratio of mixed amines X/Y (molar ratio) | 40/60 | 80/20 |
| | Antioxidant [3] | | 5.0 | 5.0 |
| | Lubricity improver [4] | | 2.0 | 2.0 |
| | Rust preventing agent [5] | | 0.5 | 0.5 |
| Kinematic viscosity at 40° C. of oil component (component remaining after removing thickener from the grease)($mm^2/s$) | | | 23.2 | 23.2 |

TABLE 2-continued

| | | | |
|---|---|---|---|
| Results | Worked penetration | 271 | 282 |
| | Oil separation at high centrifugal force (% by mass) | 17.7 | 19.0 |

Remarks:
6) Urea thickener 2: product obtained by reacting diphenylmethane-4,4'-diisocyanate with a two-fold molar amount of mixed amines (a mixture of n-octadecylamine and cyclohexylamine), [(X + Y)/(X + Y + Z)] × 100 = 100, X/Y = 0/100 to 80/20
1) to 5) are the same as those in Table 1

Examples 9 to 12

Greases having the compositions shown in Table 3 were prepared in the same manner as that in Example 1 using the base oil, the viscosity increasing agent and the urea thickener as shown in Table 3. The urea thickeners used in these examples were prepared using different chain hydrocarbon amines in the raw material mixed amines.

Each of the thus obtained greases was measured for the worked penetration and subjected to the oil separation test under high centrifugal force. The results are summarized in Table 3.

TABLE 3

| | | | Example | |
|---|---|---|---|---|
| | | | 9 | 10 |
| Composition (% by mass) | Base oil 1 | | balance | balance |
| | Urea thickener 3 7) | Compounding amount | 15.6 | 15.7 |
| | | Kind of chain hydrocarbon amine | n-octyl amine | n-dodecyl amine |
| | Antioxidant 3) | | 5.0 | 5.0 |
| | Lubricity improver 4) | | 2.0 | 2.0 |
| | Rust preventing agent 5) | | 0.5 | 0.5 |
| Kinematic viscosity at 40° C. of oil component (component remaining after removing thickener from the grease) ($mm^2/s$) | | | 23.2 | 23.2 |
| Result | Worked penetration | | 275 | 275 |
| | Oil separation at high centrifugal force (% by mass) | | 21.3 | 14.3 |

| | | | Example | |
|---|---|---|---|---|
| | | | 11 | 12 |
| Composition (% by mass) | Base oil 1 | | balance | balance |
| | Urea thickener 3 7) | Compounding amount | 14.5 | 14 |
| | | Kind of chain hydrocarbon amine | n-tetra decylamine | n-octa decylamine |
| | Antioxidant 3) | | 5.0 | 5.0 |
| | Lubricity improver 4) | | 2.0 | 2.0 |
| | Rust preventing agent 5) | | 0.5 | 0.5 |
| Kinematic viscosity at 40° C. of oil component (component remaining after removing thickener from the grease) ($mm^2/s$) | | | 23.2 | 23.2 |
| Result | Worked penetration | | 279 | 284 |
| | Oil separation at high centrifugal force (% by mass) | | 11.9 | 9.1 |

Remarks:
7) Urea thickener 3: product obtained by reacting diphenylmethane-4,4'-diisocyanate with a two-fold molar amount of mixed amines (a mixture of the chain hydrocarbon amine shown and cyclohexylamine), [(X + Y)/(X + Y + Z)] × 100 = 100, X/Y = 20/80
1) to 5) are the same as those in Table 1

From the results shown in Table 1, it is appreciated that the greases of the present invention (Examples 1 to 3) are excellent in engagement property throughout the temperature range of −30 to 80° C., particularly at low temperatures and have good bearing life at high temperatures and reduced oil separation under high centrifugal force. In contrast, the grease of Comparative Example in which an alkylbenzene is used as a base oil, the grease of Comparative Example 2 in which a diester having a total carbon number of 26 is used and greases of Comparative Examples 4 to 6 which are commercial products, are all unsatisfactory with respect to the engagement property at low temperature (−30° C.). The grease of Comparative Example 3 in which a neopentyl ester is used as a base oil is problematic with respect to its performance at high temperature and has short bearing life at high temperatures, though the engagement property thereof is good.

From the results shown in Table 2, it is also understood that the greases of the present invention (Examples 9 to 12) show oil separation at high centrifugal force of 20% by mass or less and that the greases having X/Y values of 8/92 and 20/80 (Examples 5 and 6) are excellent in this respect.

Additionally, from the results shown in Table 3, it is appreciated that oil separation is further reduced when the chain hydrocarbon (alkyl) amine used in the raw material mixed amines has a carbon number of 12 (Example 10), a carbon number of 14 (Example 11) and a carbon number of 18 (Example 12) and that the greases of Example 11 (carbon number: 14) and of Example 12 (carbon number: 18) are excellent in this respect.

INDUSTRIAL APPLICABILITY

The grease according to the present invention is excellent in both low-temperature performance and high-temperature performance and has low oil separation tendency even under high centrifugal force (acceleration) and may be used in various applications. In particular, when the grease is used in a rotational transmission device having a built-in one-way clutch, the grease can provide satisfactory clutch engagement property (intermeshing ability) at low temperatures and a prolonged bearing life at high temperatures and is less apt to cause oil separation under high centrifugal force. Therefore, the grease may be suitably used in various rotational transmission devices having a built-in one-way clutch.

The invention claimed is:

1. A grease comprising:

a base oil comprising at least 70% by mass of the base oil, of a diester compound having a total carbon number of 30, said diester compound represented by formula (I):

$$R^1OOC—(R^2)_n—COOR^3 \quad (I)$$

wherein $R^1$ and $R^3$ each independently represent a $C_4$ to $C_{20}$ monovalent aliphatic hydrocarbon group, $R^2$ represents a $C_1$ to $C_{20}$ divalent hydrocarbon group and n is 0 or 1, and from 10 to 30% by mass of the grease of a urea thickener, wherein the urea thickener is a diurea compound represented by formula (V):

$$R^4—NHCONH—R^5—NHCONH—R^6 \quad (V)$$

wherein $R^4$ and $R^6$ each independently represent a $C_6$ to $C_{24}$ monovalent chain hydrocarbon group or a $C_6$ to $C_{12}$ monovalent alicyclic hydrocarbon group, and $R^5$ represents a $C_6$ to $C_{15}$ divalent aromatic hydrocarbon group, where groups $R^4$ and $R^6$ satisfy formula (b):

$$X/Y=30/70 \text{ to } 5/95 \quad (b)$$

where X is a mole % of the chain hydrocarbon groups and Y is a mole % of the alicyclic hydrocarbon groups in the groups $R^4$ and $R^6$.

2. The grease as defined in claim 1, wherein $R^1$ and $R^3$ each represent a branched, monovalent aliphatic hydrocarbon group.

3. The grease as defined in claim 1, wherein n is 1, $R^2$ represents a $C_3$ to $C_{15}$ divalent hydrocarbon group, and $R^1$ and $R^3$ independently represent a $C_6$ to $C_{17}$ monovalent aliphatic hydrocarbon group.

4. The grease as defined in claim 1, further comprising at least one additive selected from the group consisting of a lubricity improver, an antioxidant and a rust preventing agent.

5. The grease as defined in claim 1, wherein an oil component of the grease has a kinematic viscosity at 40° C. of 15 to 150 $mm^2/s$, said oil component present after removing the thickener from the grease.

6. The grease as defined in claim 1, wherein the chain hydrocarbon group represented by $R^4$ and $R^6$ has a carbon number of 13 to 20.

7. The grease as defined in claim 1, wherein the grease is present in a rotational transmission device.

8. The grease as defined in claim 1, wherein the grease is present in a rotational transmission device having a built-in one-way clutch.

9. The grease as defined in claim 1, wherein the base oil comprises 90% by mass or more of said diester and said grease comprises 10 to 30% by mass, based on the grease, of said urea thickener and 10% or less of another base oil.

10. The grease as defined in claim 1, wherein the urea thickener is a product obtained by reacting diphenylmethane-4,4'-diisocyanate with a mixture of n-octadecylamine and cyclohexylamine.

11. The grease as defined in claim 9, wherein the urea thickener is a product obtained by reacting diphenylmethane-4,4'-diisocyanate with a mixture of n-octadecylamine and cyclohexylamine.

12. The grease as defined in claim 1, wherein the ratio X/Y is from 20/80 to 8/92.

13. The grease as defined in claim 1, wherein the diester compound is diisodecyl sebacate.

* * * * *